US006332471B1

(12) United States Patent
Lai

(10) Patent No.: US 6,332,471 B1
(45) Date of Patent: Dec. 25, 2001

(54) FIXING STRUCTURE FOR LARGE-SIZE SUNSHADE

(76) Inventor: Jin-Sheng Lai, 4F, No. 77, Nan-Jing E. Rd. Sec. 4, Taipei (TW)

( * ) Notice: Subject to any disclaimer, the term of this patent is extended or adjusted under 35 U.S.C. 154(b) by 0 days.

(21) Appl. No.: 09/666,286

(22) Filed: Sep. 21, 2000

(51) Int. Cl.[7] ..... A45B 9/02

(52) U.S. Cl. ..... 135/16; 135/20.1; 135/20.3; 135/21; 135/27; 135/34.2; 135/98; 135/908

(58) Field of Search ..... 135/98, 908, 99, 135/15.1, 19, 19.5, 20.1, 20.3, 21, 22, 24, 25.4, 42, 34.2, 16, 27, 28; 248/499, 353

(56) References Cited

U.S. PATENT DOCUMENTS

| | | | | |
|---|---|---|---|---|
| 4,606,366 | * | 8/1986 | Collet | 135/20 |
| 5,152,495 | * | 10/1992 | Jacinto et al. | 248/545 |
| 5,518,218 | * | 5/1996 | Leonard | 248/530 |
| 5,749,386 | * | 5/1998 | Samuel, Jr. | 135/16 |
| 5,785,069 | * | 7/1998 | Glatz | 135/20.1 |
| 5,937,882 | * | 8/1999 | Harbaugh | 135/20.3 |
| 5,960,806 | * | 10/1999 | Steiner | 135/20.1 |
| 6,014,980 | * | 1/2000 | Glatz | 135/20.1 |
| 6,058,951 | * | 5/2000 | Wilson | 135/20.3 |
| 6,105,594 | * | 8/2000 | Diaz | 135/16 |
| 6,173,721 | * | 1/2001 | Mery | 135/16 |
| 6,223,759 | * | 5/2001 | Flippin, Jr. | 135/34.2 |

* cited by examiner

*Primary Examiner*—Yvonne M. Horton
(74) *Attorney, Agent, or Firm*—Bacon & Thomas, PLLC

(57) ABSTRACT

Fixing structure for large-size sunshade, including a series of chain elements, a locating seat and a locating pin. The series of chain elements are composed of several identically-sized chain elements looped with each other and tied to a middle section of a sunshade pull cord. Two ends of the series of chain elements are respectively connected with an upper cord body and a lower cord body of the pull cord. The locating seat is locked on a lower end of the sunshade stem and has two cantilevers parallel to each other. The two cantilevers define therebetween a split for the chain element to pass therethrough. Each of the cantilevers is formed with a locating notch opposite to the other. The locating pin is a rectangular bar member having a length able to cross two sides of the split. The locating pin has a width corresponding to the width of the locating notch of the locating seat. One end of the locating pin is pivotally connected in the locating notch of one cantilever, while the other end thereof is able to bridge over the split to be latched in the locating notch of the other cantilever. The series of chain elements are passed through the split and chucked by the two cantilevers on two sides of the split so as to fix the pull cord and then the locating pin is latched in the locating notches so as to prevent the chain elements from slipping out of the split.

1 Claim, 4 Drawing Sheets

Proior Art

FIXING STRUCTURE FOR LARGE-SIZE SUNSHADE

BACKGROUND OF THE INVENTION

The present invention relates to a fixing structure for large-size sunshade, and more particularly to a fixing structure which is able to reliably fix the pull cord for stretching the sunshade without loosening or slippage.

A conventional large-size sunshade is composed of a sunshade stem, ribs and a sunshade cover. The sunshade stem generally has a length of about two meters. When the sunshade cover is stretched open, a projecting stop block at upper end of the sunshade stem stretches and supports the ribs. For resisting against strong wind, the stop block has strong strength. Accordingly, when collapsing the sunshade cover, a user must exert a great force onto the stop block for depressing the same. Therefore, it is strength-consuming to stretch open or collapse the sunshade cover and such operation can be hardly completed by one single person.

FIG. 1 shows an improved large-size sunshade in which a pulley B is disposed at upper end of the sunshade stem A. One end of a pull cord C is fixed on the sunshade beehive D, while the other end thereof is wound around the pulley B and then suspended on outer side of the sunshade stem A. The bottom section of the sunshade stem A has several projecting transverse beams E. When stretching open the sunshade cover F, on one hand, the sunshade beehive D is pushed upward and on the other hand, the pull cord C is pulled downward so as to share the force necessary for stretching the sunshade. After the sunshade cover F is stretched open, the lower end of the pull cord C is tied and fixed on the transverse beams E of the sunshade stem A. Therefore, the sunshade beehive D is pre vent ed from sliding down.

Such measure for fixing the pull cord has a shortcoming of unstability. When winding the pull cord on the transverse beam at the first place, the frictional force is insufficient for stopping the upper sunshade beehive from sliding downward. Therefore, the user must on one hand pull the pull cord to prevent the pull cord from sliding and on the other hand wind the pull cord. This is inconvenient and the user tends to fail to successfully fix the pull cord. Even if the pull cord is totally wound on the transverse beam, it can be hardly ensured that the pull cord will not loosen or detach from the transverse beam. Therefore, such fixing structure still needs to be improved.

SUMMARY OF THE INVENTION

It is therefore a primary object of the present invention to provide a fixing structure for large-size sunshade which is able to reliably fix the pull cord for stretching the sunshade without loosening or slippage.

According to the above object, the fixing structure for large-size sunshade of the present invention includes a series of chain elements, a locating seat and a locating pin. The series of chain elements are composed of several identically-sized chain elements looped with each other and tied to a middle section of a sunshade pull cord. Two ends of the series of chain elements are respectively connected with an upper cord body and a lower cord body of the pull cord. The locating seat is locked on a lower end of the sunshade stem and has two cantilevers parallel to each other. The two cantilevers define therebetween a split for the chain element to pass therethrough. Each of the cantilevers is formed with a locating notch. The adjacent chain elements are normal to each other so that when one chain element enters the split, the chain element immediately looped under this chain element will be chucked by the two cantilevers on two sides of the split so as to stop the chain elements from moving upward. The locating pin is a rectangular bar member having a length able to cross two sides of the split. The locating pin has a width corresponding to the width of the locating notch of the locating seat. One end of the locating pin is pivotally connected in the locating notch of one cantilever, while the other end thereof is able to bridge over the split to be latched in the locating notch of the other cantilever. When the locating pin is latched in the locating notches of the locating seat, the chain elements are prevented from slipping out of the split.

The present invention can be best understood through the following description and accompanying drawings wherein:

DETAILED DESCRIPTION OF THE PREFERRED EMBODIMENT

Figure 1:
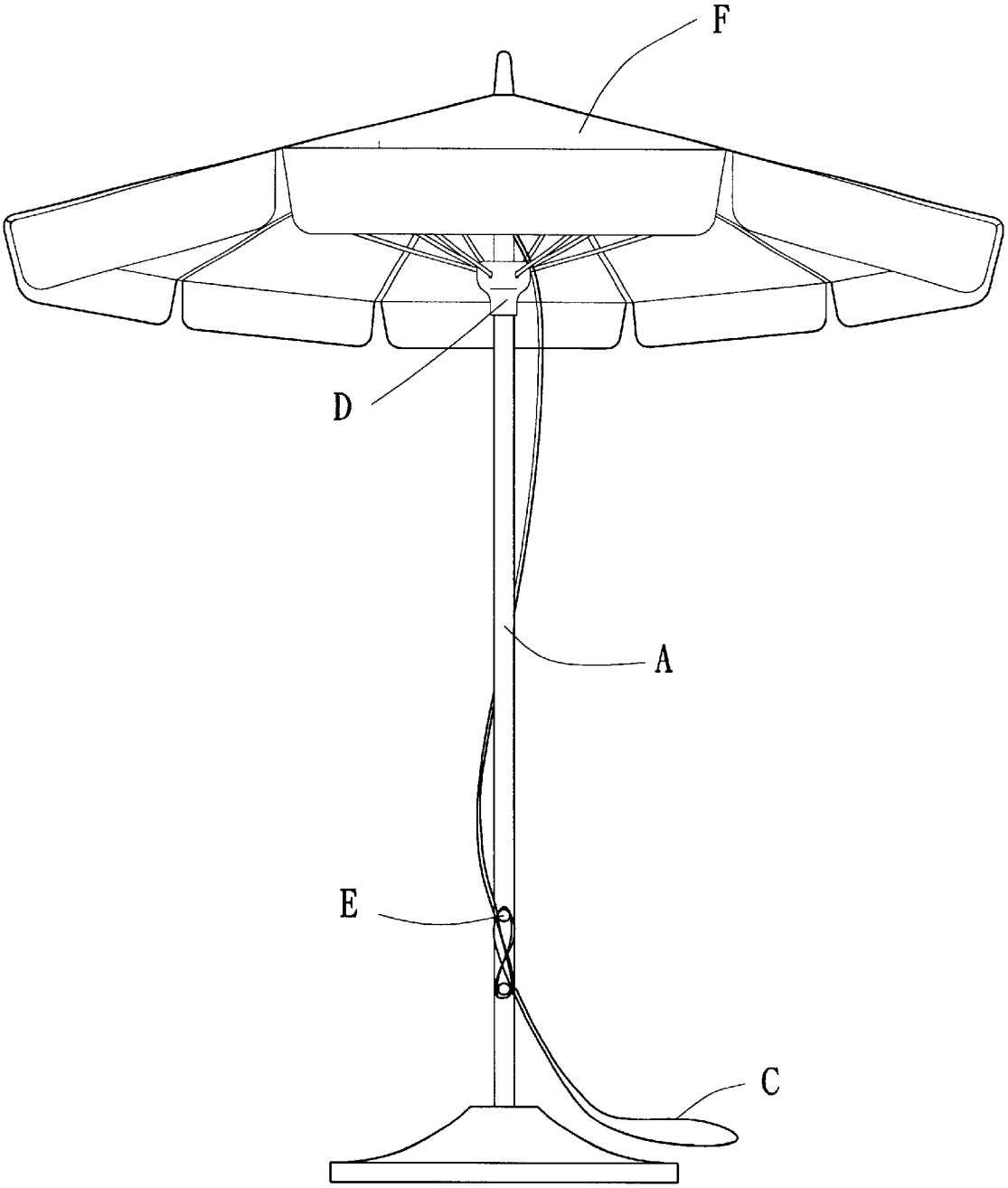
FIG. 1 is a perspective view of a conventional large-size sunshade.
Figure 2:
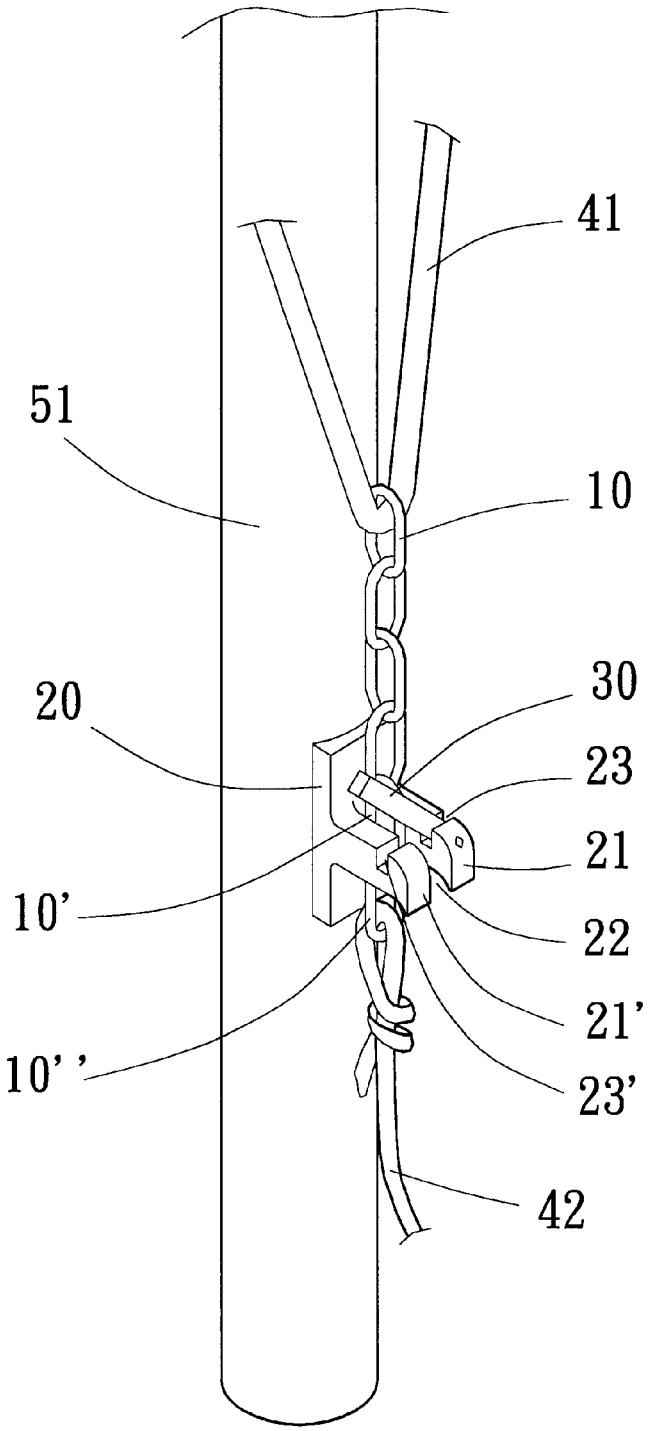
FIG. 2 is a perspective view of a preferred embodiment of the present invention.

Please refer to FIG. 2. According to a preferred embodiment, the present invention includes a series of chain elements 10, a locating seat 20 and a locating pin 30. The series of chain elements 10 include several identically-sized chain elements 10 looped with each other and tied to a middle section of the sunshade pull cord 40. Two ends of the series of chain elements are respectively connected with an upper cord body 41 and a lower cord body 42 of the pull cord 40. The upper cord body 41 is wound over the pulley 43 at the top end of the sunshade stem 51 and connected to the sunshade hive 52 (referring to FIG. 3). The lower cord body 42 is for a user to pull the sunshade hive 52. The back face of the locating seat 20 is arched and locked on the circumference of the lower end of the sunshade stem 52. The locating seat 20 has two outward extending cantilevers 21, 21' parallel to each other. The two cantilevers 21, 21' define therebetween a split 22 for the chain element 10 to pass therethrough. The split 22 has a width slightly larger than the thickness of the chain element 10. Each of the cantilevers 21, 21' is formed with a locating notch 23, 23' for receiving a locating pin 30 therein. The locating pin 30 is a rectangular bar member having a length able to cross two sides of the split 22. The locating pin 30 has a width corresponding to the width of the locating notch 23. One end of the locating pin 30 is pivotally connected in the locating notch 23 of one cantilever 21, while the other end thereof can bridge over the split 22 to be latched in the locating notch 23' of the other cantilever 21'.

Figure 3:
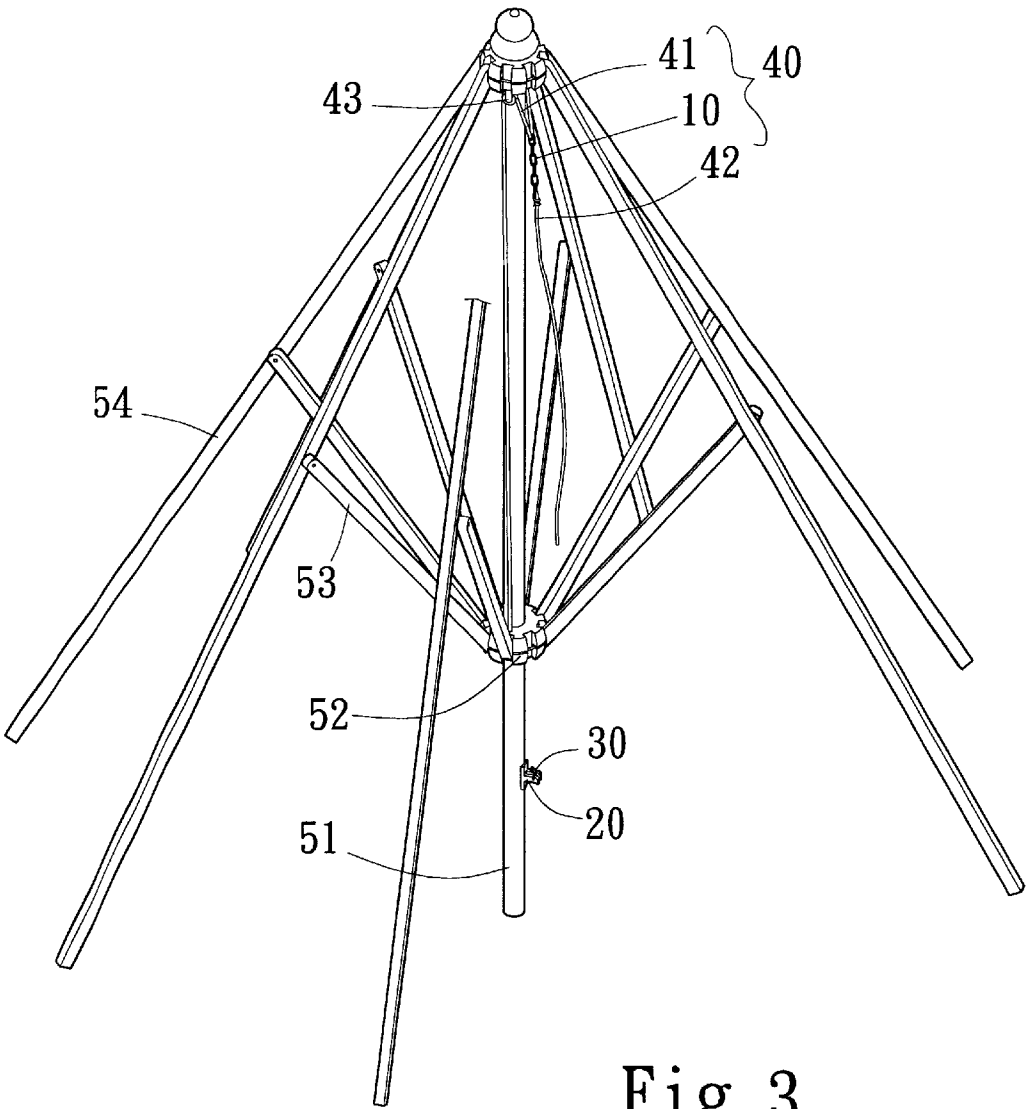
FIG. 3 is a side view of the preferred embodiment of the present invention, showing one using state thereof.
Figure 4:
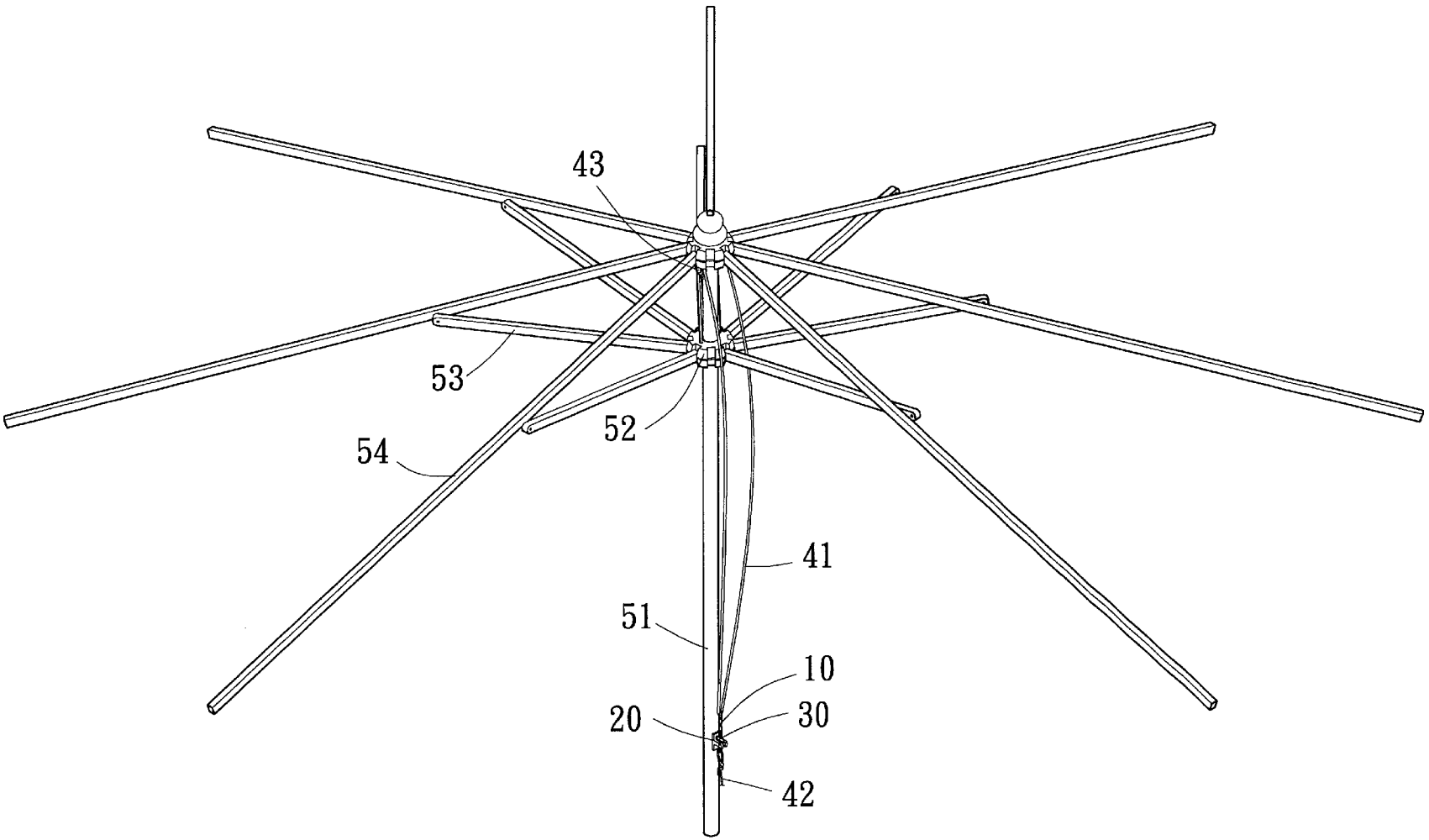
FIG. 4 is a side view of the preferred embodiment of the present invention, showing another using state thereof.

The present invention is operated in a manner as follows:

Please refer to FIGS. 2 to 4. When stretching open the sunshade, the lower cord body 42 suspending on outer side of the sunshade stem 51 is pulled downward. Via the upper cord body 41 winding over the pulley 43 at top end of the sunshade stem 51, the sunshade hive 52 is pulled upward so that the lower ribs 53 stretch open the upper ribs 54. After the upper ribs 54 are stretched to a certain extent, the series of chain elements 10 reach a position near the locating seat 20. Then some chain elements 10 are pushed into the split 22 of the locating seat 20. In the case that the chain elements 10 on relatively upper side are positioned in the split 22, the sunshade is stretched to a greater extent. In the case that the chain elements 10 on relatively lower side are positioned in the split 22, the sunshade is stretched to a less extent. The adjacent chain elements 10 are normal to each other so that when one chain element 10' enters the split 22, the chain element 10 immediately looped under this chain element 10' will be chucked by the two cantilevers 21 on two sides of the split 22. The resistance is great enough to resist against the upward pulling force exerted onto the pull cord 40 by the downward sliding sunshade hive 52. Then the locating pin 30 is placed down to bridge over the split 22 and be latched in the locating notches 23 so as to prevent the chain element 10 from slipping out of the split 22.

When collapsing the sunshade, the user only needs to take up the locating pin 30 and pull the chain element 10 out of the split 22. At this time, the sunshade hive 52 will naturally slide down due to the gravity of the ribs 54 so as to collapse the sunshade.

The above embodiment is only used to illustrate the present invention, not intended to limit the scope thereof. Many modifications of the above embodiment can be made without departing from the spirit of the present invention.

What is claimed is:

1. Fixing structure for large-size sunshade, comprising:

a series of chain elements composed of several identically-sized chain elements looped with each other and tied to a middle section of a sunshade pull cord, two ends of the series of chain elements being respectively connected with an upper cord body and a lower cord body of the pull cord;

a locating seat locked on a circumference of lower end of the sunshade stem, the locating seat having two cantilevers parallel to each other, the two cantilevers defining therebetween a split for the chain element to pass therethrough, the split having a width slightly larger than the thickness of the chain element, each of the cantilevers being formed with a locating notch;

a locating pin which is a rectangular bar member having a length able to cross two sides of the split, the locating pin having a width corresponding to the width of the locating notch of the locating seat, one end of the locating pin being pivotally connected in the locating notch of one cantilever, while the other end thereof being able to bridge over the split to be latched in the locating notch of the other cantilever, whereby the series of chain elements are passed through the split and chucked by the two cantilevers on two sides of the split so as to fix the pull cord and then the locating pin is latched in the locating notches so as to prevent the chain elements from slipping out of the split.

* * * * *